US008777564B2

(12) United States Patent
Zeng et al.

(10) Patent No.: US 8,777,564 B2
(45) Date of Patent: Jul. 15, 2014

(54) HYBRID FLOW BLADE DESIGN

(75) Inventors: Xiaoqiang Zeng, Schenectady, NY (US); Jonathon Edward Slepski, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 502 days.

(21) Appl. No.: 13/109,226

(22) Filed: May 17, 2011

(65) Prior Publication Data

US 2012/0294722 A1 Nov. 22, 2012

(51) Int. Cl.
*F01D 9/02* (2006.01)

(52) U.S. Cl.
USPC .... 415/192; 415/208.2; 416/243; 416/DIG. 5

(58) Field of Classification Search
USPC ..... 415/191, 192, 208.1, 208.2, 211.2; 416/223 R, 223 A, 238, 243, DIG. 2, 416/DIG. 5
See application file for complete search history.

(56) References Cited

U.S. PATENT DOCUMENTS

| | | | | |
|---|---|---|---|---|
| 2,801,790 | A * | 8/1957 | Doll, Jr. | 415/210.1 |
| 5,088,892 | A * | 2/1992 | Weingold et al. | 415/193 |
| 5,906,474 | A | 5/1999 | Haller et al. | |
| 6,036,438 | A * | 3/2000 | Imai | 415/192 |
| 6,109,869 | A | 8/2000 | Maddaus et al. | |
| 6,779,973 | B2 * | 8/2004 | Ito et al. | 415/191 |
| 2006/0210395 | A1 * | 9/2006 | Schuster et al. | 415/208.1 |

* cited by examiner

*Primary Examiner* — Edward Look
*Assistant Examiner* — Juan G Flores
(74) *Attorney, Agent, or Firm* — Hoffman Warnick LLC; Ernest G. Cusick

(57) ABSTRACT

Airfoils according to embodiments of this invention result in a hybrid controlled flow concept that reduces leakage loss by creating a different vortexing concept near endwall regions of the airfoils than at the core region of the airfoils. Specifically, a turbine static nozzle airfoil is disclosed having a variable, non-linear, throat dimension, s, divided by a pitch length, t, distribution ("s/t distribution") across its radial length. In one embodiment, a plurality of static nozzle airfoils are provided, with each static nozzle airfoil configured such that a throat distance between adjacent static nozzle airfoils is larger proximate the hub regions of the airfoils than proximate the core regions of the airfoils, and the throat distance between adjacent static nozzle airfoils is smaller proximate the tip regions of the airfoils than proximate the core regions.

11 Claims, 7 Drawing Sheets

HYBRID FLOW BLADE DESIGN

BACKGROUND OF THE INVENTION

The subject matter disclosed herein relates to a turbomachine. Specifically, the subject matter disclosed herein relates to stationary blade design that results in a hybrid vortexing flow as operating fluid moves through the turbomachine.

Turbines (e.g., steam turbines or gas turbines) include static nozzle (or "airfoil") segments that direct flow of a working fluid into turbine buckets connected to a rotor. A complete assembly of nozzle segments is sometimes referred to as a diaphragm stage (e.g., a diaphragm stage of a steam turbine), where a plurality of stages form a diaphragm assembly. The diaphragm assembly is designed to convert thermal energy of the working fluid to tangential momentum that is used to drive the bucket and rotor. During this process, leakage flow through the cavities between rotating parts and stationary parts can reduce turbine efficiency because of the amount of leakage flow and the intrusion loss from the interaction of the core flow and leakage flow. Through design of the blade geometry, aerodynamic loss can be reduced and accordingly the efficiency (power output) of the turbine increases.

BRIEF DESCRIPTION OF THE INVENTION

Airfoils according to embodiments of this invention result in a hybrid controlled flow concept that reduces leakage loss by creating a different vortexing concept near endwall regions of the airfoils than at the core region of the airfoils. Specifically, a turbine static nozzle airfoil is disclosed having a variable, non-linear, throat dimension, s, divided by a pitch length, t, distribution ("s/t distribution") across its radial length. In one embodiment, a plurality of static nozzle airfoils are provided, with each static nozzle airfoil configured such that a throat distance between adjacent static nozzle airfoils is larger proximate the hub regions of the airfoils than proximate the core regions of the airfoils, and the throat distance between adjacent static nozzle airfoils is smaller proximate the tip regions of the airfoils than proximate the core regions.

A first aspect of the invention provides a turbine static nozzle airfoil having a hub region proximate a first end, a tip region proximate a second end, and a core region disposed there between, the turbine static nozzle airfoil having a variable throat dimension, s, divided by a pitch length, t, ("s/t") distribution across a radial length of the turbine static nozzle airfoil, wherein the s/t distribution comprises an s/t with respect to a radius ratio, wherein the radius ratio comprises a radius at a given location on the airfoil divided by a radius at a middle of the airfoil, and wherein the variable s/t distribution is non-linear across the radial length of the airfoil.

A second aspect of the invention provides a turbomachine comprising: a plurality of static nozzle airfoils each having a hub region proximate a first end, a tip region proximate a second end, and a core region disposed there between, wherein a throat distance comprises a minimum distance between a trailing edge of a first airfoil to a suction side of a second, adjacent airfoil; wherein each static nozzle airfoil is configured such that the throat distance between adjacent static nozzle airfoils is larger proximate the hub regions than proximate the core regions, and the throat distance between adjacent static nozzle airfoils is smaller proximate the tip regions than proximate the core regions.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
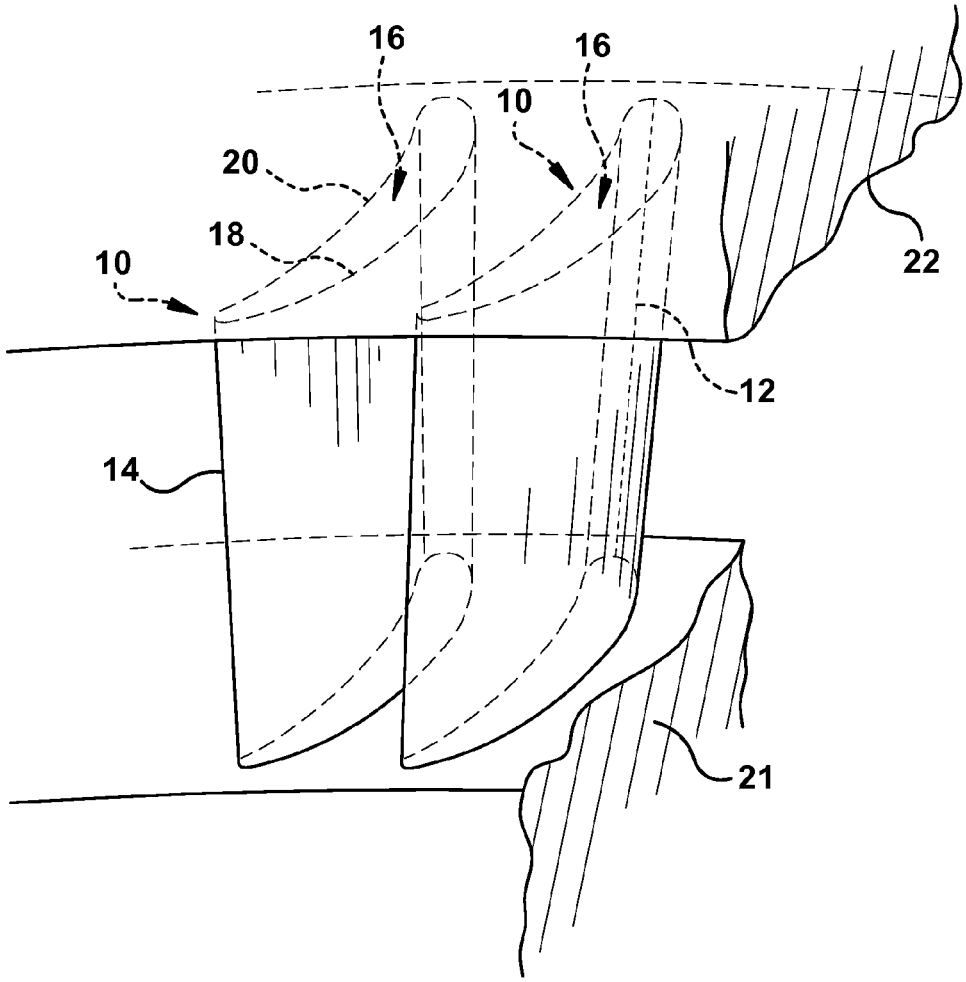
FIG. 1 shows a three-dimensional perspective view of two adjacent static nozzle airfoils as known in the art.

It is noted that the drawings of the invention may not necessarily be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 2:
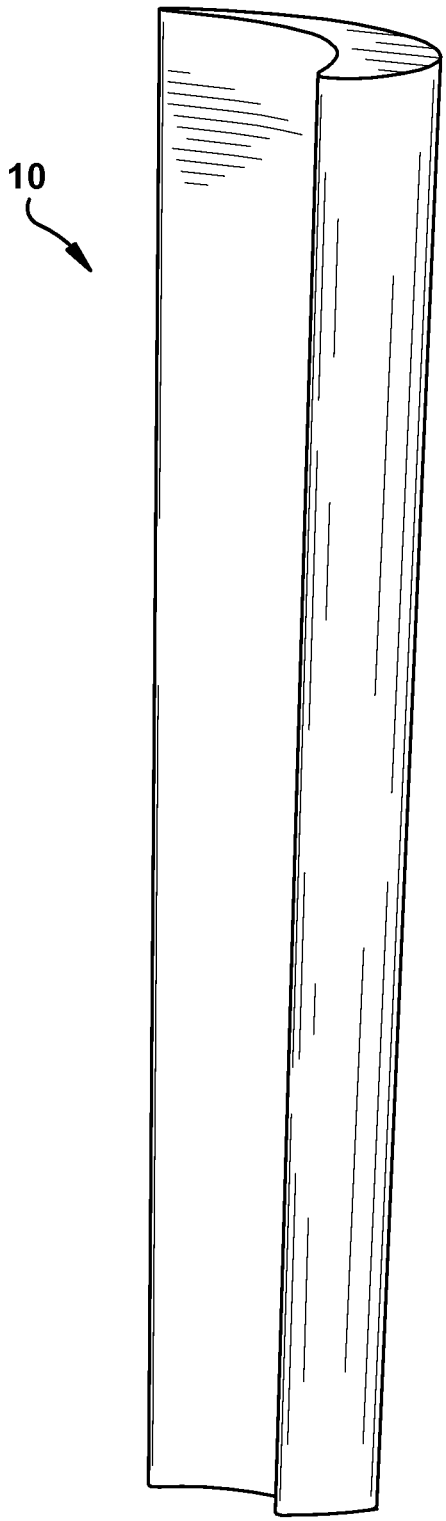
FIG. 2 shows a three-dimensional perspective view of a static nozzle airfoil as known in the art.

Turning to FIG. 1, a three-dimensional perspective view of two adjacent static nozzle airfoils 10 as known in the art is shown. Static nozzle airfoil 10 (also referred to as blade 10) includes a leading edge 12 and a trailing edge 14 opposing leading edge 12. Static nozzle airfoil 10 further includes a body portion 16 located between leading edge 12 and trailing edge 14. Body portion 16 includes a convex suction side 18 and a concave pressure side 20 opposing suction side 18. Another view of a nozzle airfoil 10 as known in the art is shown in FIG. 2. As will be discussed in more detail herein (and illustrated in FIG. 5), nozzle airfoil 10 is referred to as a free vortex nozzle because it has an s/t distribution (throat dimension divided by the pitch length) that linearly increases with radius at a specific rate.

Figure 3:
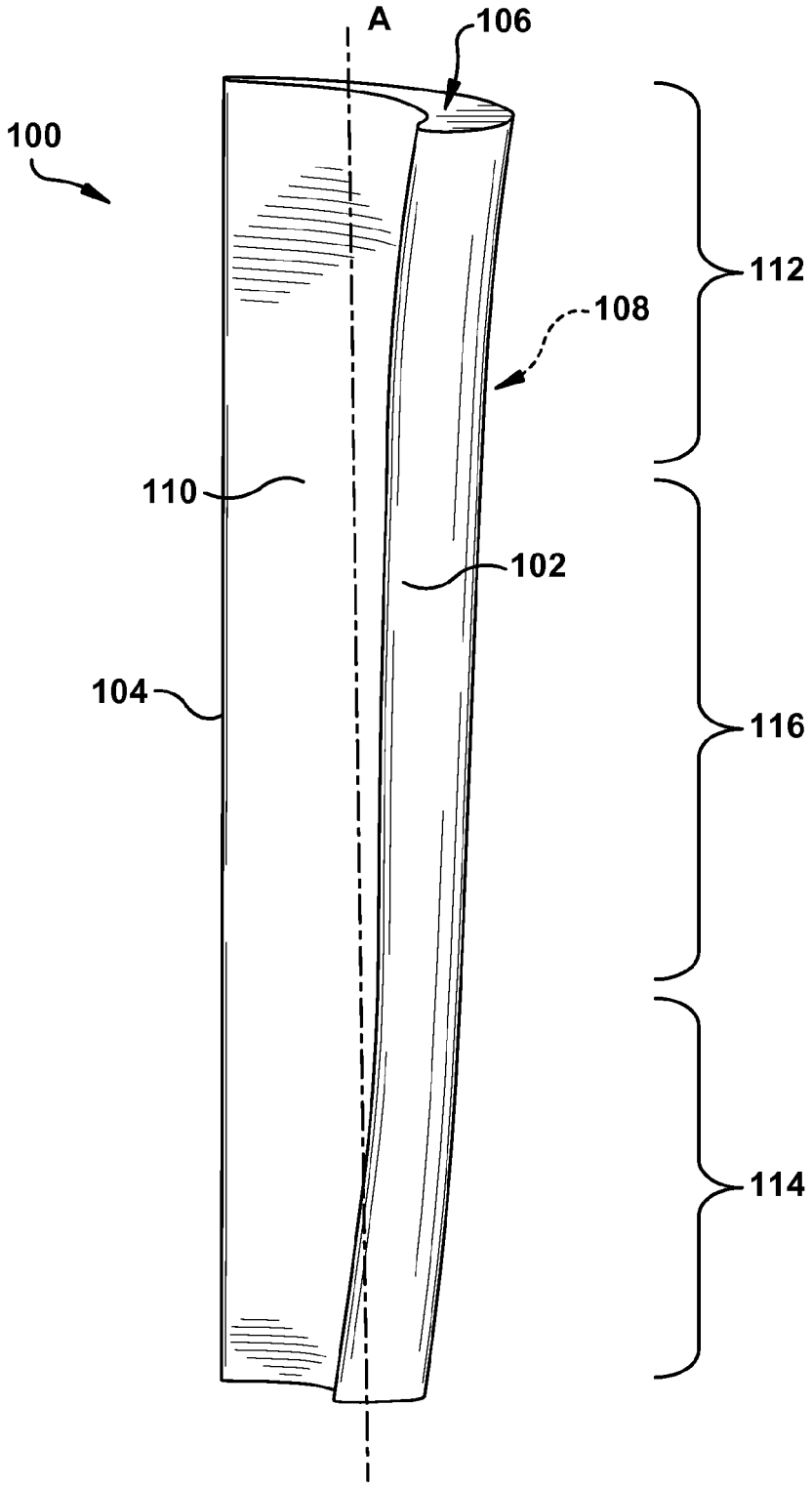
FIG. 3 shows a three-dimensional perspective view of a static nozzle airfoil according to an embodiment of this invention.

Turning to FIG. 3, a three-dimensional perspective view of a static nozzle airfoil 100 is shown according to an embodiment of this invention. As discussed in more detail herein, a technical effect of this invention includes airfoil 100 which results in a hybrid controlled flow concept that reduces leakage loss by creating a different vortexing concept near endwall regions of airfoil 100 than at the core region of airfoil 100. Static nozzle airfoil 100 (also referred to as blade 100) includes a leading edge 102 and a trailing edge 104 opposing leading edge 102. Static nozzle airfoil 100 furthers include a body portion 106 located between leading edge 102 and trailing edge 104. Body portion 106 includes a suction side 108 (only partially visible from view shown in FIG. 2) and a pressure side 110 opposing suction side 108.

In addition, as understood by one in the art and shown in FIG. 3, each blade 100 in a turbomachine has an upper region 112 (also referred to as a tip region), a lower region 114 (also referred to as a hub region), and a core region 116 disposed between upper region 112 and lower region 114. Upper and lower regions 112, 114 generally refer to the portions of airfoil 100 that are proximate to sidewalls (not shown) of a turbomachine to which upper and lower regions 112, 114 are attached. Core region 116 generally refers to the middle or center portions of airfoil 100 between the tip/upper and hub/lower regions.

Figure 4:
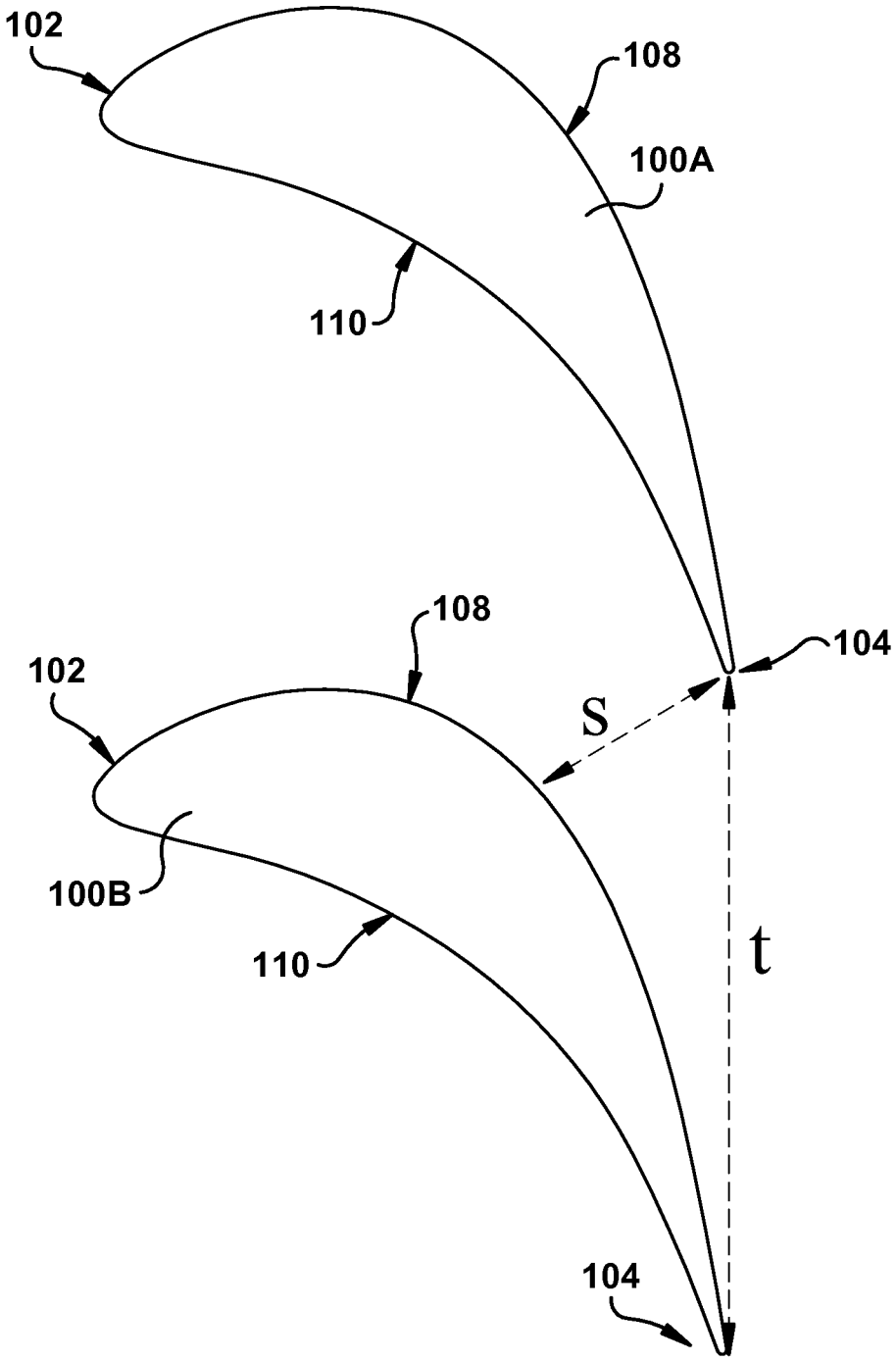
FIG. 4 shows a top down view of two adjacent static nozzle airfoils according to an embodiment of this invention.

One parameter in the design of nozzle airfoils is a ratio referred to as an "s/t" ratio, defined as "throat dimension"

divided by "pitch length." These dimensions are shown in FIG. 4. FIG. 4 shows a top down view of two adjacent blades. "Pitch length", t, is defined as the circumferential distance between two adjacent airfoils 100 at a constant radius. "Throat dimension", s, is defined as the minimum distance from trailing edge 104 of a first blade 100A to suction side 108 of an adjacent blade 100B. In a three dimensional blade, the s/t value may be different at every radial span location, resulting in a radial distribution of the s/t value, referred to as the s/t distribution. A turbine designer can change the s/t distribution, i.e., the radial distribution of s/t, to maximize the turbine efficiency. In turbine blade terminology, that profile is called vortexing. The classic s/t distribution profile is linear with a specific slope, i.e., the s/t increases linearly with radius, and is referred to as free vortexing.

Figure 5:
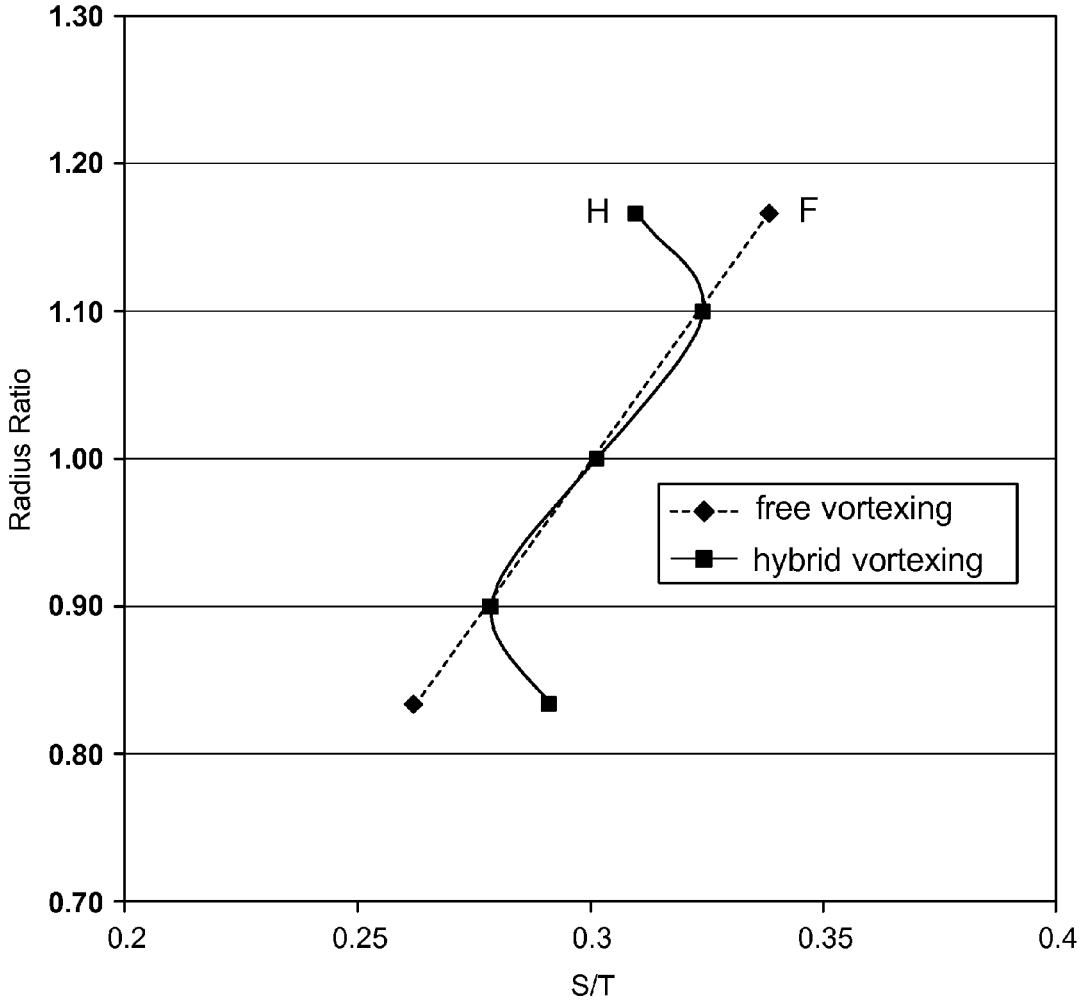
FIG. 5 shows a line graph plotting radius ratio versus s/t distribution.

Turning to FIG. 5, a line graph plotting radius ratio versus s/t distribution is shown. The straight line, F, is a classic s/t distribution that linearly increases with radius ratio at a specific rate. An airfoil design with an s/t distribution similar to the straight line F is referred to as a free vortex design, and has been widely used in the industry. In contrast, embodiments of the invention disclosed herein result in an s/t distribution as represented by the line H. Compared with free vortex design, the s/t distribution profile represented by line H is non-linear, and can result from an increase in the throat area of the blade near the inner diameter end wall region, i.e., near the hub region, and a decrease in the throat area near the outer diameter endwall region, i.e., near the tip region. The non-linear s/t distribution similar to line H in FIG. 5 is referred to herein as "hybrid vortexing." In one embodiment, hub region 114 can have an s/t distribution of up to approximately 40% larger than the s/t distribution of the free vortex design at the same radius region, and tip region 112 can have an s/t distribution of up to approximately 40% smaller than the s/t distribution of the free vortex design at the same radius region.

Another way to describe FIG. 5 is in terms of the s/t variation rate with respect to a radius ratio. One characteristic of an s/t distribution is the variation rate of s/t with respect to a radius ratio, i.e., the normalized radius. The term "normalized radius," as used herein, refers to the radius at a given location divided by the radius at the middle of the span. Therefore, the radius ratio comprises a radius at a given location on the airfoil divided by a radius at the middle of the airfoil.

In one embodiment of this invention, the turbine static nozzle airfoil has a first s/t distribution in the core region, a second s/t distribution in the hub region, and a third s/t distribution in the tip region, wherein the plot of the first, second and third s/t distributions is non-linear. For example, the non-linear plot can comprise the reverse S-shaped plot shown in FIG. 5. As shown in FIG. 5, the s/t distribution in the core region is substantially linear, but at the hub and tip regions, the s/t distribution is non-linear with respect to the core region.

Figure 6:
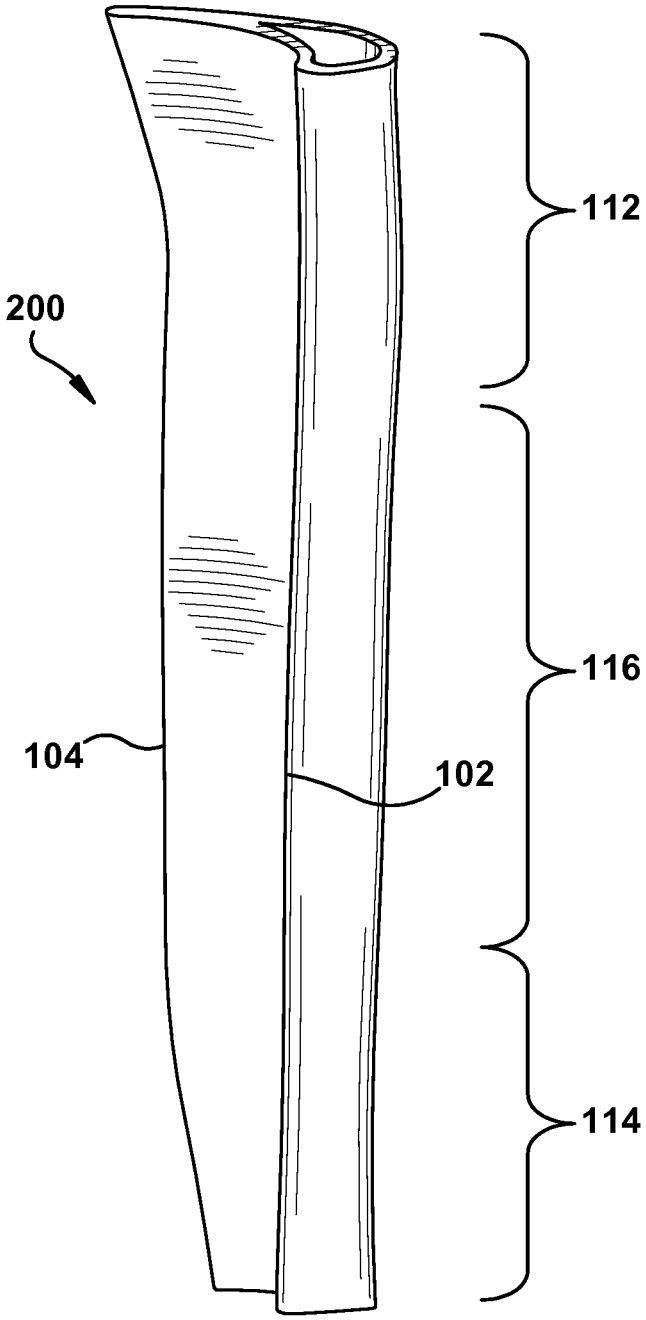
FIGS. 6-8 show three-dimensional perspective views of static nozzle airfoils according to different embodiments of this invention.
Figure 7:
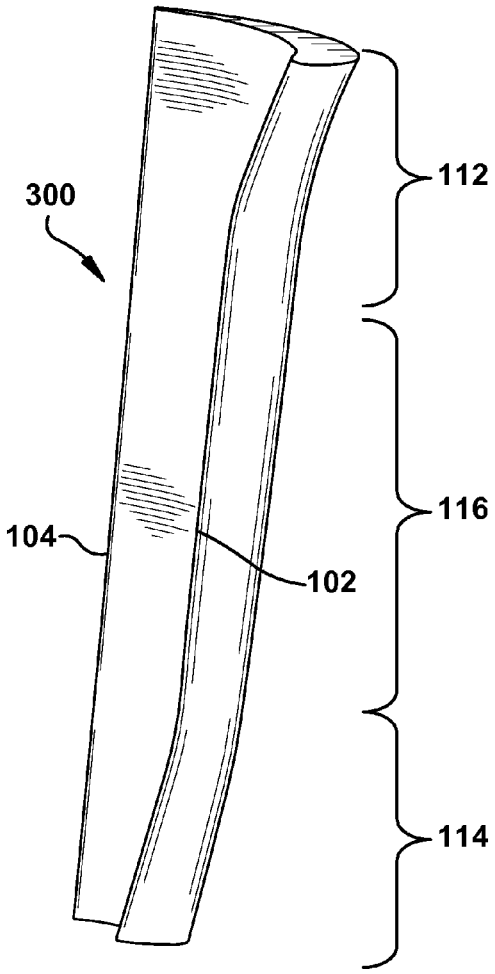
Figure 8:
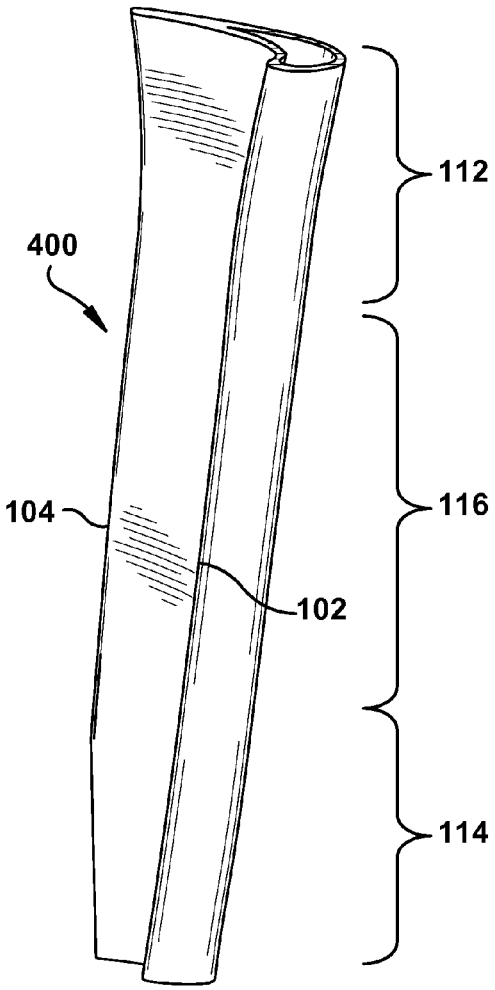

The turbine designer can achieve hybrid vortexing by several different methods and each method can generate different blade geometries. For example, the upper and lower span regions of a blade can be rotated around their own trailing edge, leading edge or center of gravity positions. Different rotational positions will generate different blade geometries. Examples of these different geometries are shown in FIGS. 6-8. Specifically, FIG. 6 shows a static nozzle airfoil 200 with tip region 112 and hub region 114 (and not core region 116) rotated around leading edge 102. FIG. 7 shows a static nozzle airfoil 300 with tip region 112 and hub region 114 (and not core region 116) rotated around trailing edge 104. FIG. 8 shows a static nozzle airfoil 400 with tip region 112 and hub region 114 (and not core region 116) rotated around a center of gravity of the airfoil. As understood by one of skill in the art, the center of gravity of the airfoil is generally the mean location of the mass of the geometry. In other words, for each two-dimensional airfoil section, the rotation is accomplished through rotation about the local two-dimensional center of gravity of that section. The angle of rotation in all three scenarios (FIGS. 6-8) can be in the range of approximately −20 degrees to approximately 20 degrees.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine static nozzle airfoil having a hub region proximate a first end, a tip region proximate a second end, and a core region disposed there between, the turbine static nozzle airfoil having a variable throat dimension, s, divided by a pitch length, t, ("s/t") distribution across a radial length of the turbine static nozzle airfoil, wherein the s/t distribution comprises an s/t with respect to a radius ratio, wherein the radius ratio comprises a radius at a given location on the airfoil divided by a radius at a middle of the airfoil, and wherein the variable s/t distribution is non-linear across the radial length of the airfoil, and wherein the s/t distribution in the core region is substantially linear and the s/t distribution at the hub region and the tip region is non-linear with respect to the core region, the hub region having a larger s/t distribution than an s/t distribution of the proximate core region and the tip region having a smaller s/t distribution than the s/t distribution of the proximate core region.

2. The turbine static nozzle airfoil according to claim 1, wherein the tip region and the core region are rotated about a leading edge of the airfoil.

3. The turbine static nozzle airfoil according to claim 2, wherein the angle of rotation of the tip region and the core region is in the range of approximately −20 degrees to approximately 20 degrees.

4. The turbine static nozzle airfoil according to claim 1, wherein the tip region and the core region are rotated about a trailing edge of the airfoil.

5. The turbine static nozzle airfoil according to claim 4, wherein the angle of rotation of the tip region and the core region is in the range of approximately −20 degrees to approximately 20 degrees.

6. The turbine static nozzle airfoil according to claim 1, wherein the tip region and the core region are rotated about a center of gravity of the airfoil.

7. The turbine static nozzle airfoil according to claim 6, wherein the angle of rotation of the tip region and the core region is in the range of approximately −20 degrees to approximately 20 degrees.

8. A turbomachine comprising:

a plurality of static nozzle airfoils each having a hub region proximate a first end, a tip region proximate a second end, and a core region disposed there between, wherein a throat distance comprises a minimum distance between a trailing edge of a first airfoil to a suction side of a second, adjacent airfoil; wherein each static nozzle airfoil is configured such that the throat distance between adjacent static nozzle airfoils is larger proximate the hub regions than proximate the core regions, and the throat distance between adjacent static nozzle airfoils is smaller proximate the tip regions than proximate the core regions, and wherein the tip regions and the core regions of each airfoil are rotated about one of a group consisting of: a leading edge of the airfoil, a trailing edge of the airfoil, and a center of gravity of the airfoil.

9. The turbomachine according to claim 8, wherein the angle of rotation of each tip region and core region is in the range of approximately −20 degrees to approximately 20 degrees.

10. The turbomachine according to claim 8, wherein the angle of rotation of each tip region and core region is in the range of approximately −20 degrees to approximately 20 degrees.

11. The turbomachine according to claim 8, wherein the angle of rotation of each tip region and core region is in the range of approximately −20 degrees to approximately 20 degrees.

* * * * *